US010316495B2

(12) United States Patent
Chioccola

(10) Patent No.: US 10,316,495 B2
(45) Date of Patent: Jun. 11, 2019

(54) SAFETY HYDRAULIC CIRCUIT

(71) Applicant: CNH Industrial America LLC, New Holland, PA (US)

(72) Inventor: Francesco Chioccola, Settimo Torinese (IT)

(73) Assignee: CNH Industrial America LLC, New Holland, PA (US)

( * ) Notice: Subject to any disclaimer, the term of this patent is extended or adjusted under 35 U.S.C. 154(b) by 132 days.

(21) Appl. No.: 15/319,673

(22) PCT Filed: Jun. 17, 2015

(86) PCT No.: PCT/EP2015/063639
§ 371 (c)(1),
(2) Date: Dec. 16, 2016

(87) PCT Pub. No.: WO2015/193394
PCT Pub. Date: Dec. 23, 2015

(65) Prior Publication Data

US 2017/0121941 A1 May 4, 2017

(30) Foreign Application Priority Data

Jun. 18, 2014 (IT) ..... MO2014A0180

(51) Int. Cl.
*F15B 20/00* (2006.01)
*E02F 9/22* (2006.01)
(Continued)

(52) U.S. Cl.
CPC ..... *E02F 9/226* (2013.01); *E02F 3/435* (2013.01); *E02F 9/123* (2013.01); *E02F 9/2285* (2013.01);
(Continued)

(58) Field of Classification Search
CPC ... F15B 20/007; E02F 3/32; E02F 9/24; E02F 9/226
See application file for complete search history.

(56) References Cited

U.S. PATENT DOCUMENTS 4,284,987 A * 8/1981 Gibson ..... B60R 16/0233 116/DIG. 13
5,160,055 A * 11/1992 Gray ..... B66C 23/90 212/278
(Continued)

FOREIGN PATENT DOCUMENTS

CN 203373804 U 1/2014
EP 0224446 A2 6/1987
(Continued)

*Primary Examiner* — Thomas E Lazo
(74) *Attorney, Agent, or Firm* — Peter K. Zacharias; Patrick M. Sheldrake

(57) ABSTRACT

A hydraulic safety circuit for use in earth-moving vehicles or agricultural vehicles or in general hydraulic machines. The hydraulic safety circuit includes a first hydraulic actuator, a pilot pump for supplying pilot operating fluid at a pilot pressure, and a signaling device controlled by the pilot fluid and operable to emit an alarm signal. The circuit further includes a balance valve subjected to pressure of the first hydraulic actuator and able to distribute the pilot operating fluid in a plurality of hydraulic activating signals; a hydraulic distributor able to assume a plurality of operating configurations and able to distribute the pilot operating fluid according to an assumed configuration; and a plurality of alarm valves controlled by the activating signals, at least one of which is arranged downstream of the hydraulic distributor, each alarm valve being able to provide the pilot fluid to the signaling device.

20 Claims, 9 Drawing Sheets

(51) Int. Cl.

| | |
|---|---|
| ***E02F 9/12*** | (2006.01) |
| ***E02F 3/43*** | (2006.01) |
| ***E02F 9/26*** | (2006.01) |
| ***E02F 9/24*** | (2006.01) |
| *E02F 3/32* | (2006.01) |

(52) U.S. Cl.
CPC ..... *E02F 9/24* (2013.01); *E02F 9/26* (2013.01); *E02F 9/264* (2013.01); *F15B 20/007* (2013.01); *E02F 3/32* (2013.01)

(56) References Cited

U.S. PATENT DOCUMENTS

| | | | | |
|---|---|---|---|---|
| 6,991,119 | B2 * | 1/2006 | Puszkiewicz | B66C 23/90 212/261 |
| 2010/0322753 | A1 * | 12/2010 | Brooks | B66C 23/90 414/718 |
| 2012/0232763 | A1 | 9/2012 | Mizuochi et al. | |

FOREIGN PATENT DOCUMENTS

| | | | |
|---|---|---|---|
| GB | 2078197 | A | 1/1982 |
| JP | 2002-250055 | A | 9/2002 |
| JP | 2007-145471 | A | 6/2007 |

* cited by examiner

| ROTATION | ARM PRESSURE 0 bar / BOOM PRESSURE | ARM PRESSURE >0 bar / BOOM PRESSURE | BUZZER |
|---|---|---|---|
| 0° - 30° | 230 bar | 190 bar | Y |
| 30° - 60° | 190 bar | 150 bar | Y |
| 60° - 90° | 150 bar | 110 bar | Y |

SAFETY HYDRAULIC CIRCUIT

CROSS REFERENCE TO RELATED APPLICATIONS

This application is the National Stage of International Application No. PCT/EP2015/063639 filed Jun. 17, 2015, which claims priority to Italian Application No. MO2014A000180 filed Jun. 18, 2014, the contents of which are incorporated herein by reference.

FIELD OF THE INVENTION

The present invention relates to a safety hydraulic circuit destined for use in hydraulic machines, such as earth moving machines.

BACKGROUND OF THE INVENTION

It is known that the stability of excavators is a function of the angular position of the upper frame ("turret") with respect to the carriage and the weight of the hanging loads suspended from the articulated excavator arm.

The excavator arm is usually defined by a lift boom, hinged to a distal arm.

In detail, the further the plane in which the excavator arm and the longitudinal axis of the carriage are located from the mutually parallel condition, the greater the risk of the machine's tipping.

The risk grows together with the weight of the load.

At present, a pressure sensor, arranged at the piston side of the boom cylinder of the boom, is used in order to prevent the risk of tipping.

When the pressure detected by the sensor exceeds a safety threshold, a signal is emitted internally of the drive cabin, for example a sound alarm, which informs the driver of the risk of vehicle instability.

As a precaution, the cited threshold relates to the value of the maximum load that can be lifted when the turret is in the riskiest position, i.e. the position in which the excavator arm is perpendicular to the axis of the carriage.

This system has the drawback of being poorly efficient.

In fact, the operator knows that the danger signal is emitted also in conditions that are not necessarily dangerous, i.e. when the pressure detected by the sensor is critical but the plane of the arm is not perpendicular to the axis of the carriage.

In the above-described circumstance, the operator will assess the risk of proceeding to the complete lifting of the load using the well-known lift tables; this is inefficient and renders partially useless the fact that an automated safety system is provided on the vehicle.

SUMMARY OF THE INVENTION

The technical objective underpinning the present invention is therefore to provide a hydraulic safety system, destined for use in hydraulic machines, in particular for earth movement, which obviates the drawbacks in the prior art.

In particular, an aim of the present invention is to provide a safety circuit which is able to evaluate conditions of danger relating to the stability of the machine, which at the same time is a function of the load to be lifted and the angular position of the turret which bears the excavator arm.

The set technical objective and the set aim are attained by the hydraulic safety circuit realized according to claim 1.

BRIEF DESCRIPTION OF THE DRAWINGS

Further characteristics and advantages of the present invention will more fully emerge from the description that follows by way of non-limiting example of a preferred but not exclusive embodiment of a hydraulic safety circuit, as illustrated in the accompanying figures of the drawings, in which.

DETAILED DESCRIPTION OF THE INVENTION

Figures 1, 1A:
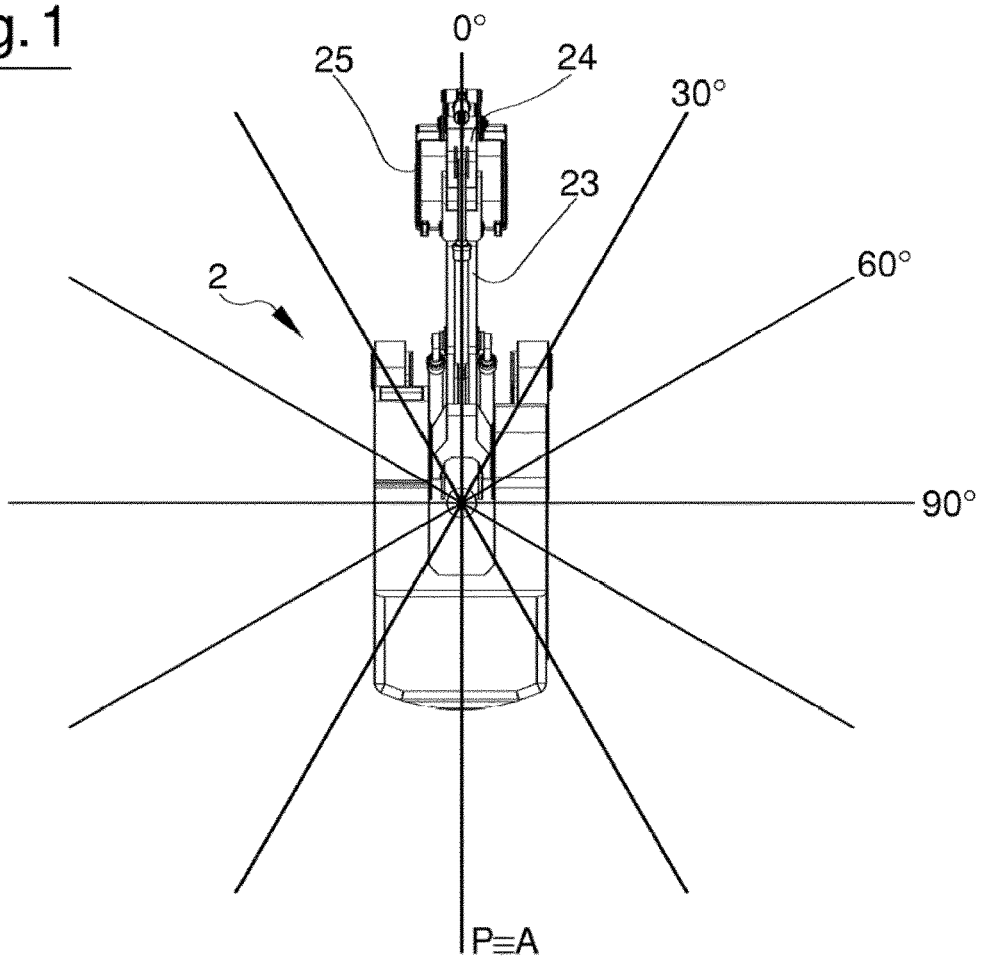
FIG. 1 is a view from above of an earth-moving machine, in which the invention can be applied, the figure showing a diagram indicating possible angular positions of the excavator arm with respect to the carriage.
FIG. 1*a* is a table illustrating the logical steps of the emission of the alarm signal, using, by way of example, the pressure values detected in actuators moving the excavator arm and according to the angular position of the turret.

With reference to the above figures, reference numeral 1 denotes the hydraulic safety circuit of the invention.

The circuit 1 is especially destined for use in earth moving machines or agricultural machines, with the aim of signalling a risk for the stability of the means during the lifting of a load.

In greater detail, the circuit is usable in hydraulic machines having a mobile part, in particular rotating, with respect to the rest of the means.

A type of machine 2 in which the circuit 1 can be installed is as described in the following.

Figure 2:
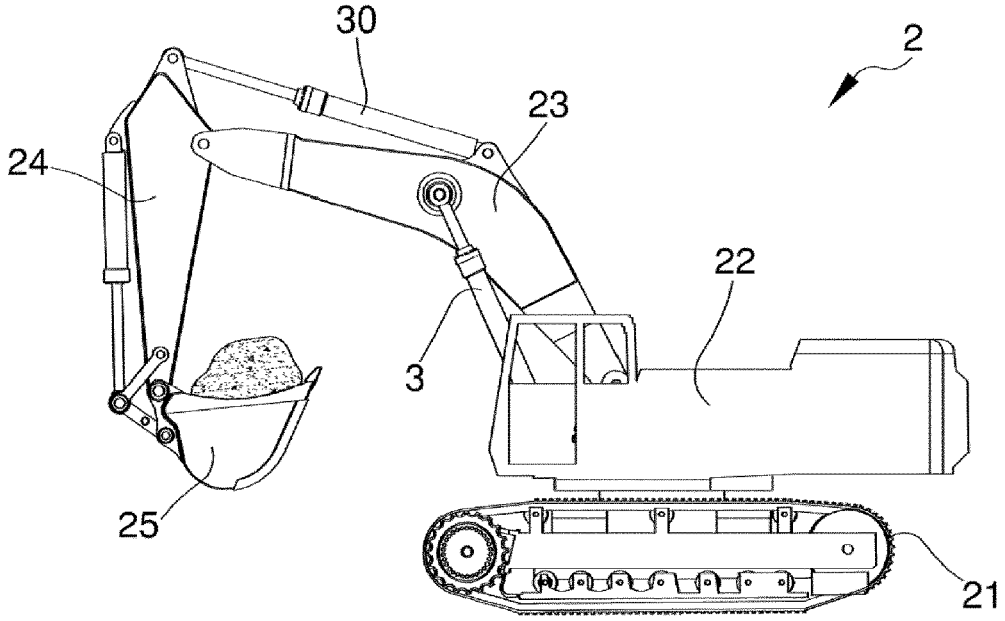
FIGS. 2 and 3 are lateral views of the machine of FIG. 1, shown in two different operating configurations.
Figure 3:
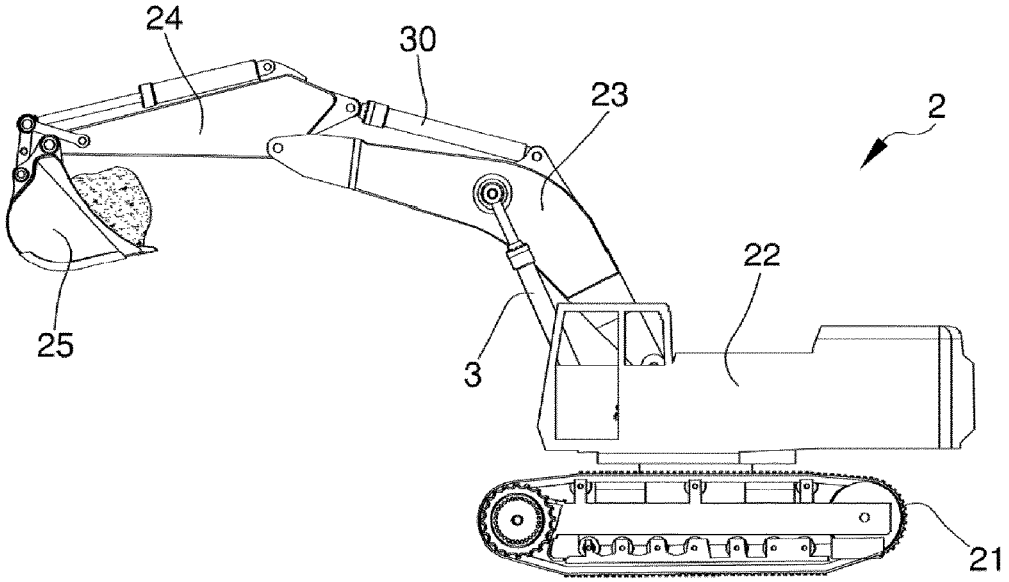

The machine 2 comprises a carriage 21, for example tracked, on which a turret 22 is rotatably mounted, which turret 22 rotates about a vertical axis (see FIGS. 1, 2 and 3).

An articulated excavator arm 23, 24 is housed on the turret 22, which also housed the control cabin. The articulated excavator arm 23, 24 comprises a boom 23 (proximal), hinged to an arm 24, the arm 24 being equipped with the excavating tool 25, such as a bucket or the like.

The arm 23, 24 thus lies on a vertical plane P, which is rotatable with respect to the axis A of the carriage 21 and which plane also identifies the advancement direction thereof (see FIG. 1).

Primarily, the proposed circuit 1 comprises a first hydraulic actuator 3, which can for example be a hydraulic cylinder controlling the movement of the boom 23.

Further, the circuit 1 includes a signalling device 4 which can for example be an acoustic signal and can emit a signal in the cabin so as to alert the operator.

In detail, in the preferred embodiment of the invention, the signalling device 4 emits an alarm in a case in which a situation of danger is created in regard to the stability of the machine 2, detected by use of the circuit of the invention.

In practice, the signalling device 4 can be of a type which emits an alarm signal following an exceeding of a pressure threshold at an inlet thereof.

For example, the signaling device 4 can include a hydraulic switch which, following the exceeding of the pressure threshold at the inlet thereof, closes an electrical circuit which activates a signal emitter.

The hydraulic circuit 1 of the invention includes a pilot pump 11 for supplying pilot work fluid (preferably a mineral oil) at a given pilot pressure which, for example, for a mini-excavator can be of 35 bar.

Downstream of the pilot pump 11, the circuit 1 comprises a balance valve 12 subjected to the pressure of the first actuator.

The pressure of the first actuator, in a case where the actuator comprises a hydraulic cylinder, can be the pressure reached at the piston side (if mounted as shown in FIGS. 2 and 3).

In practice, the balance valve 12 is a hydraulically-activated directional valve, controlled by the pressure of the first actuator 3, according to which it variously distributes the pilot fluid.

This is implemented by means of a fluid-dynamic communication, using mineral oil, between the inside of the first actuator 3 and the balance valve 12.

In detail, the pilot fluid in outlet from the balance valve 12 assumes a form of a plurality of hydraulic activating signals S1, S2, S3 which control further components of the circuit 1, described in the following, arranged on respective branches located downstream of the balance valve 12.

The balance valve 12 is preferably of the normally-closed type, and comprises a plurality of positions, for example four, and has an elastic-type return.

Further, the balance valve 12 exhibits a further hydraulic pilot on the spring side able to modify the pre-load of the spring by an amount required to obtain the situation detailed in the following.

The balance valve 12 changes position according to the value of the pressure at the inlet thereof, to which corresponds a difference in pressure to which the first actuator 3 is subjected during use of the excavator arm 23, 24.

This characteristic will be further explored during the explanation of the functioning of the invention.

In a further aspect of the invention, the circuit 1 includes hydraulic distribution means 13, arranged downstream of the pilot pump 11, in parallel with the balance valve 12, able to assume a plurality of operating configurations and further intended to distribute the pilot fluid according to the specific configuration assumed.

The distribution means 13 are preferably fashioned in a device that is solidly constrained to or in any case connected to the turret 22 and able to change configuration according to the angular position of the turret 22.

In detail, the distribution means 13 can comprise a swivel joint, coaxial to the turret 22, of a type for transmitting an operating fluid, externally of the circuit 1 of the invention, from one or more pumps, located on-board the frame of the vehicle 2, to one or more actuators located on-board the carriage 21.

A swivel joint of this type is described in Italian patent application no MO2014A000102 which is incorporated with the present description for purposes of reference.

The reason for this solution will be further clarified exhaustively in the paragraphs relating to the functioning of the invention.

More in general, various embodiments of the invention can be comprised, in which to the various configurations of the distribution means 13 correspond respective spatial positions assumed by a part of the machine 1, which for example includes at least the first actuator, with respect to the rest of the machine.

The circuit 1 includes a plurality of alarm valves 14, 15, 16 downstream of the balance valve 12, controlled by respective activating signals dispensed by the balance valve 12.

The alarm valves 14, 15, 16 are arranged in parallel to one another and are preferably three in number.

The alarm valves 14, 15, 16 are predisposed on control to send the pilot fluid to the signalling device 4.

In detail, in the preferential version of the invention, a first alarm valve 14 is arranged directly downstream of the pilot pump 11, while the remaining valves 15, 16 are arranged downstream of the distribution means 13.

The reason for this constructional choice will be clarified during the explanation of the functioning of the invention.

The alarm valves 14, 15, 16 can be hydraulically-controlled valves, three-way and two-position, monostable and normally closed.

In practice, once opened by the relative activating signal, each valve 14, 15, 16 can send the pilot fluid, at the pilot pressure, in inlet to the signalling device 4 so as to activate the signalling device 4.

Note that the distribution means 13 are predisposed in the circuit 1 for sending the pilot fluid to a different alarm valve 15, 16, alternatively on the basis of the specific operating configuration assumed thereby, which, as mentioned, preferably corresponds to a given angular position of the turret 22.

At the same time the balance valve 12 assumes different positions according to the pressure level of the first actuator 3 and in all positions sends an activating signal to a specific alarm valve 14, 15, 16.

For the sake of precision, the balance valve 12 moves into the various open positions according to the pressure of the first actuator 3, so as to sequentially open the alarm valves 14, 15, 16.

In practice, therefore, each alarm valve functions as an AND logic operator in activating the alarm signal.

The circuit 1 of the invention can also include a second hydraulic actuator 30 comprising a hydraulic cylinder, which, in the preferred version of the invention, is mounted on the excavator arm 23 24 and activates the horizontal lifting of the arm.

In this case, as partly anticipated in the preceding, the invention also comprises a pre-loading valve 17, arranged downstream of the pilot pump 11 and subjected to the second actuator 30.

In practice, the pre-loading valve 17 can enable or prevent the pilot fluid from acting as a pressure signal on the distribution valve, according to the pressure of the second actuator 30.

The preloading valve 17 is normally open and, if not excited, sends the pilot pressure to add to the elastic return of the balance valve 12 so as to define a preload to be exceeded in order to displace the balance valve from the open position.

The preloading valve 17 is preferably a two-position three-way valve.

When the arm 24, once the load has been engaged, is arranged horizontally, the pressure of the second actuator 30 grows up to the point of switching the preloading valve 17 into a closed configuration, with practical effects illustrated in the following.

In the preferred embodiment of the invention, the balance valve 12 has four positions, of which a closed position and three open positions, in which the valve 12 moves according to the pressure of the first actuator 3, with values that are detailed in the following.

In the same embodiment, the distribution means 13 have three configurations corresponding to three angular positions of the turret 22.

Before explaining further optional constructional aspects, the functioning of the preferred embodiment of the circuit 1 of the invention will be described with the aid of FIGS. 4 to 10.

Note that in the diagrams of the hydraulic circuit 1 illustrated in the accompanying tables, the branches drawn in a continuous line are those in which the pilot pressure or the pressure of the actuators 3, 30 is present, while the branches represented in a broken line are those without.

In detail, four different operating conditions are initially explained, which have in common the fact that the excavator arm 23, 24 is in a frontal position, but distinguished by the different load conditions (FIGS. 4-7).

The arm 23, 24 is in the frontal position if the angular position of the turret 22 is such that the plane P of the arm 23, 24 is at most displaced by 30° from the vertical plane which contains the longitudinal axis A of the carriage 21 of the machine 2.

Note that the angle delimiting the frontal condition of the arm 23, 24 can also be different from the preferential value of 30°.

In any case, in this situation the distribution means 13 are in the closed configuration.

In the four operating conditions first examined, the arm 24 is arranged substantially vertically, which means that the second actuator 30 is inactive.

In the initial operating condition, the excavator arm 23, 24 is at rest or in any case the pressure of the first actuator 3 responsible for the lifting of the boom 23 is lower than a first load threshold.

The first threshold, in the example reported in FIG. 1*a*, can be lower than 150 bar.

In this condition, the balance valve 12 is in the closed position.

In this situation, the stability of the machine 2 is not at risk.

Figure 4:
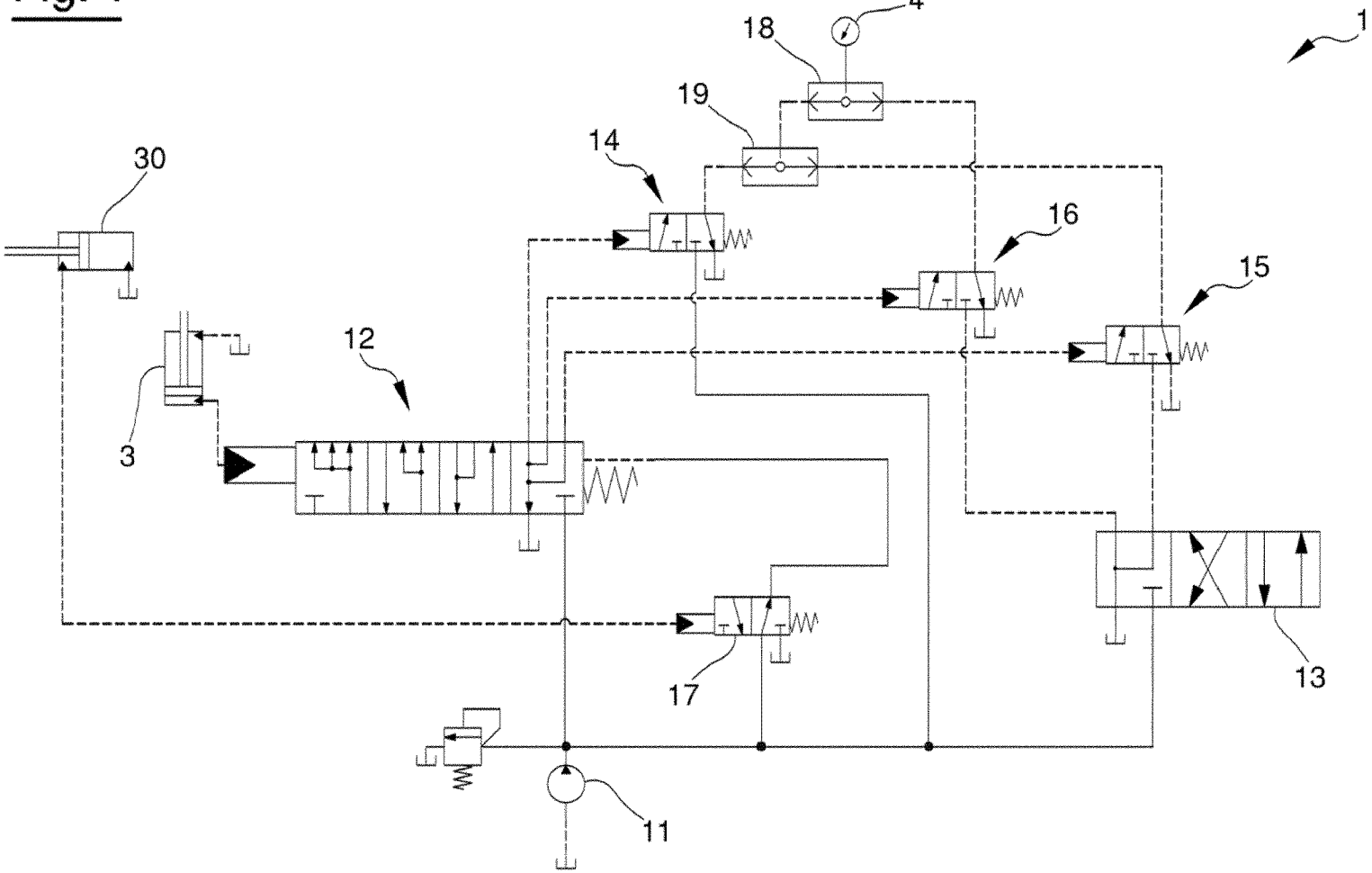
FIGS. 4-10 are schematic representations of the circuit of the invention, shown in different functioning modes.

The functioning of the circuit 1, in this circumstance, is represented schematically in FIG. 4.

In this preliminary condition, the pilot fluid reaches only the first alarm valve 14, while it stops at the distributing means 13 before arriving at the second or third valve 15, 16. However, given that no activating signal from the balance valve 12 arrives at the first alarm valve 14, the first alarm valve 14 does not switch from the closed position and therefore does not send pilot fluid to the signalling device 4, which thus remains inactive.

In a following operating condition, the pressure of the piston side of the first actuator 3 grows up to or beyond a first load valve that can be more than 150 bar, for example 160 bar, and anyway less than 190 bar.

Figure 5:
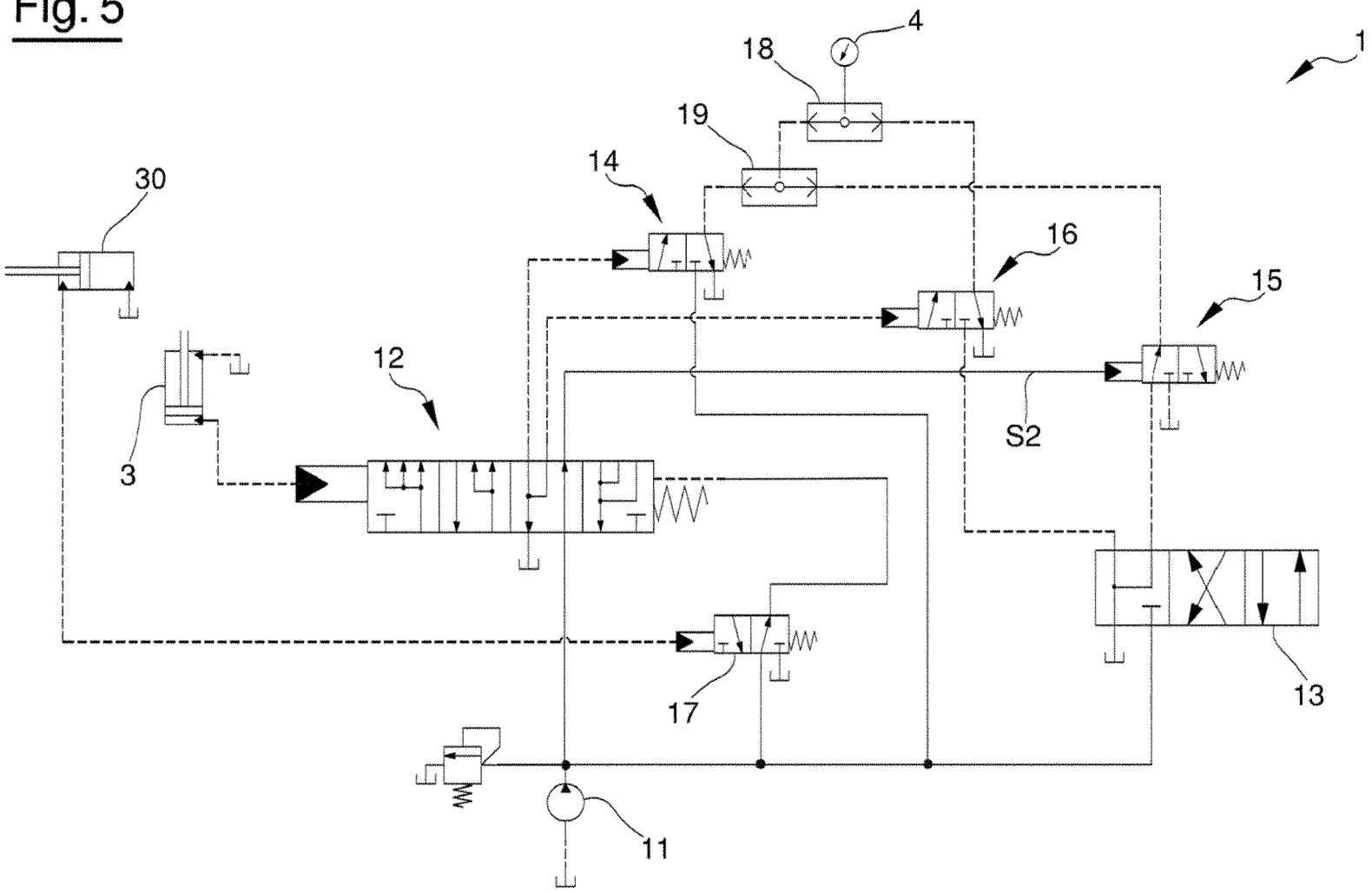

The functioning of the circuit 1 in this situation is illustrated in FIG. 5. In this condition, the balance valve 12 switches into the first open position thereof and therefore sends an activating signal S2 to the second alarm valve 15 which, in turn, switches into the open position.

However, given that the distribution means 13 are in the closed position, the pilot fluid cannot pass through the branch of the circuit which comprises the second alarm valve and therefore the signalling device 4 remains inactive.

In fact, the condition of the above-described machine 2 is not at risk in terms of the stability thereof, as the value of the load is not exorbitant and the arm 23, 24 is in the frontal position, i.e. the least dangerous position.

Figure 6:
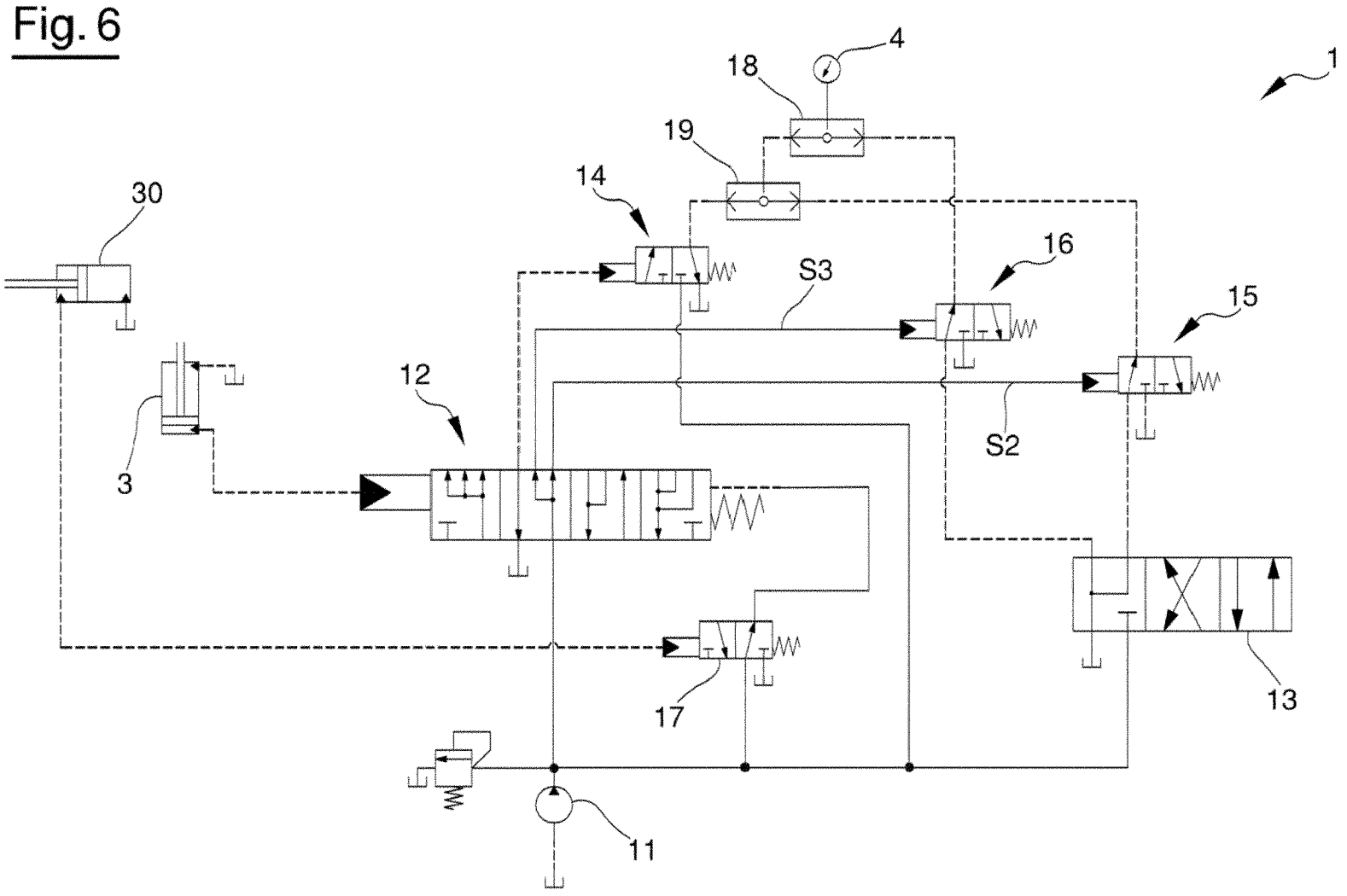

In a case in which the pressure in the first actuator 3 grows up to a second load valve, for example 200 or anyway more than 190 bar, the operating condition of FIG. 6 is reached.

In this case, the balance valve 12 displaces into the second open position and sends an activating signal S3 also to the third loading valve 16, maintaining the second valve 15 open too.

Notwithstanding this, given that the distributing means 13 are in the closed position, the pilot pressure does not reach the inlet of the signalling device 4, which therefore remains "silent".

In fact, this operating condition is also to be considered not dangerous.

When the pressure of the stem side of the first actuator 3 reaches, for example, 240 bar or anyway more than 230 bar, or another load value chosen for the purpose, even if the excavator arm 23, 24 is in the frontal position, with the arm vertical 24, there is still a situation of risk for the stability of the vehicle 1, as the load is too high.

In this situation, the balance valve 12 displaces into the third open position in which it controls the opening also of the first alarm valve 14 which, as explained herein above, is located directly downstream of the pilot pump 11.

Figure 7:
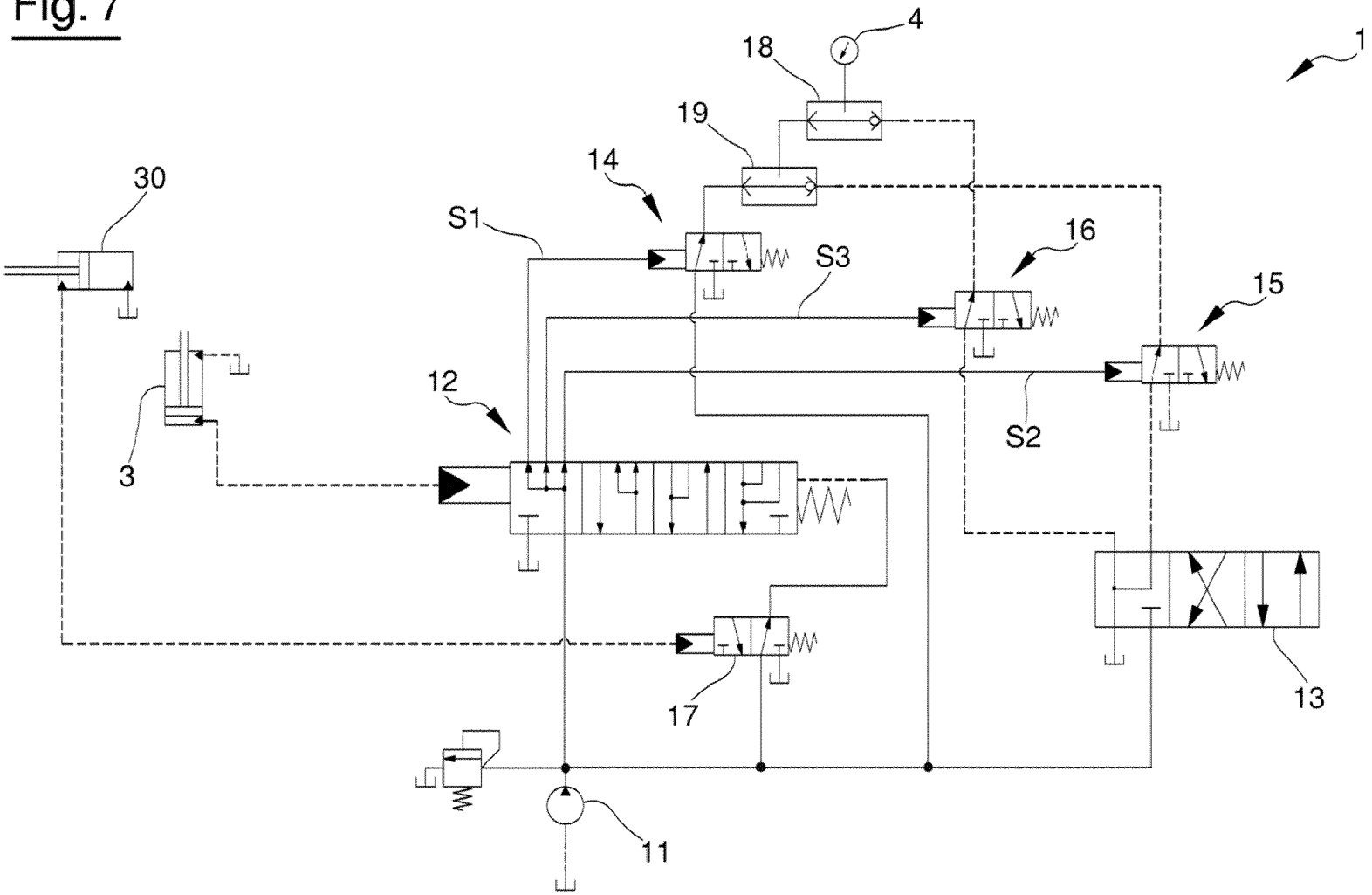

Therefore, the pilot fluid passes into the branch of the circuit which leaves from the pump 11 and reaches the signalling device 4, encountering the first valve 14, which thus raises the pressure in inlet to the device 4 (see FIG. 7).

The signalling device 4 emits and alarm for warning the operator of the situation of risk; thus the operator does not proceed with the raising of the load that has been qualified as excessive.

Note that optionally, in the circuit 1 of the invention, there is present at least a fluid selector valve 18, 19, arranged interposingly between the alarm valves 14, 15, 16, and the signalling device 4; the reason for this constructional choice will be detailed herein below.

In a different operating condition, the excavator arm 23, 24 is in an oblique position, i.e. is distanced from the axis A of the carriage 21 by an angle of greater than 30° and less than 60°.

In this case too, the angular position values indicated above are meant as preferential and not limiting.

In this circumstance, as is known, the risk of instability is increased with respect to the frontal condition of the arm 23, 24.

Figure 8:
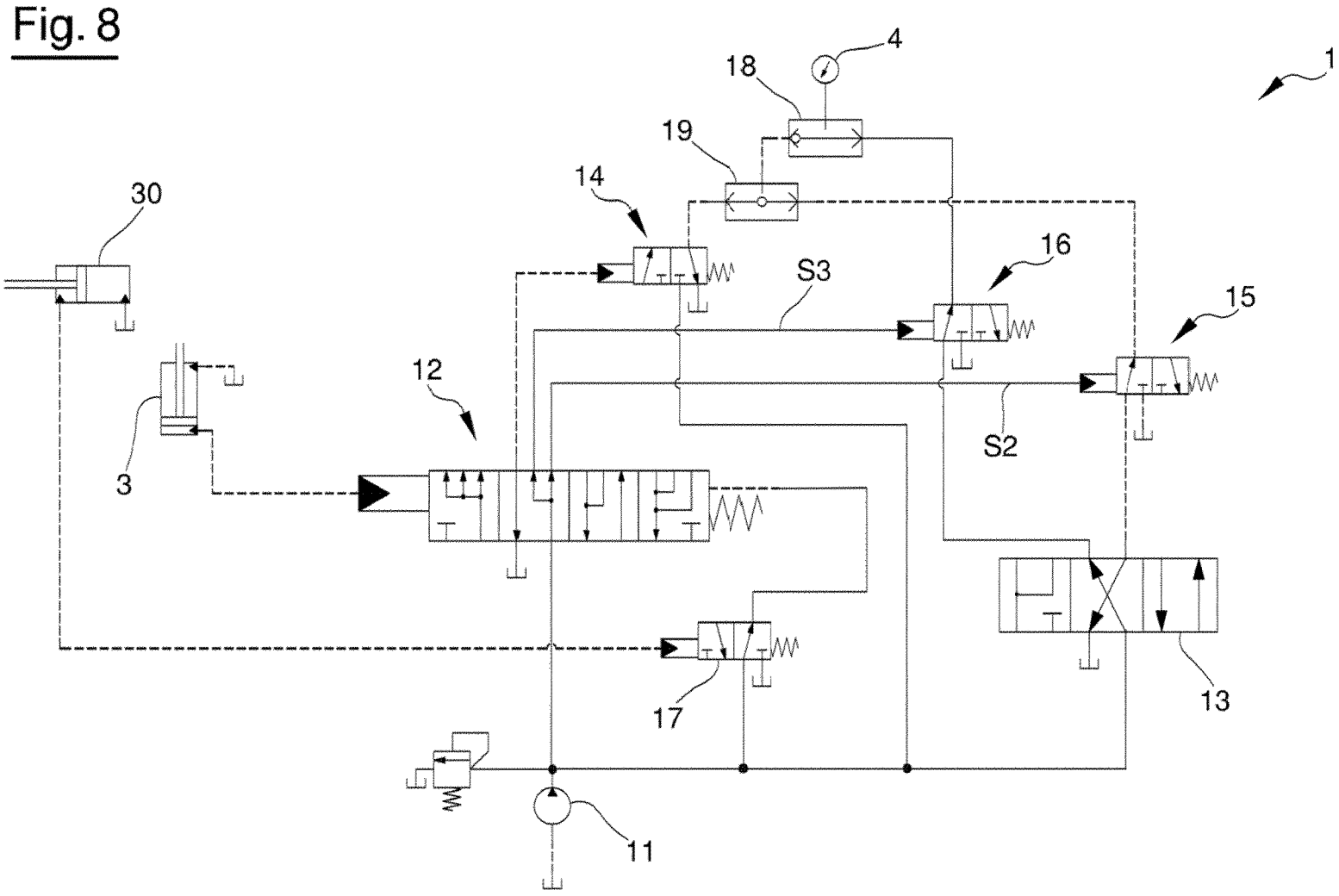

If the pressure of the first actuator 3 is such as to move the balance valve into the second position, for example 200 bar or anyway more than 190 bar, the circuit 1 of the invention assumes the configuration shown in FIG. 8.

The distribution means 13 assume a first open configuration in which they enable the pilot pressure to reach the third alarm valve 16 which, as explained above, is opened by the control signal of the balance valve 12.

Therefore, the pressure in inlet to the signalling device 4 is raised to the value of the pilot pressure and therefore produces an alarm signal.

In fact, in this situation, the load to be raised is at a value that did not constitute a risk in the case of the arm 23, 24 in the frontal position, but which is dangerous with the turret rotated 22 by an angle of greater than 30°.

It can therefore be understood how the invention, differently to the prior art, is able to adapt the danger threshold of the load to be lifted according to the angular position of the excavator arm 23, 24.

In this way, the operator does not need to consult any tables and can further use the means for lifting and displacing, entirely safely, loads that in the prior art system were, as a precaution, deemed as dangerous even when the arm 23, 24 was not in a perpendicular position to the axis A of the carriage 21.

Note that by increasing the number of alarm valves 14, 15, 16 and by accordingly increasing the positions/configurations of opening of the balance valve 12 and the distribution means 13 it is possible to obtain a finer regulation of the dangerous load threshold according to the angular position of the turret 22 and the load values to be lifted.

Figure 9:
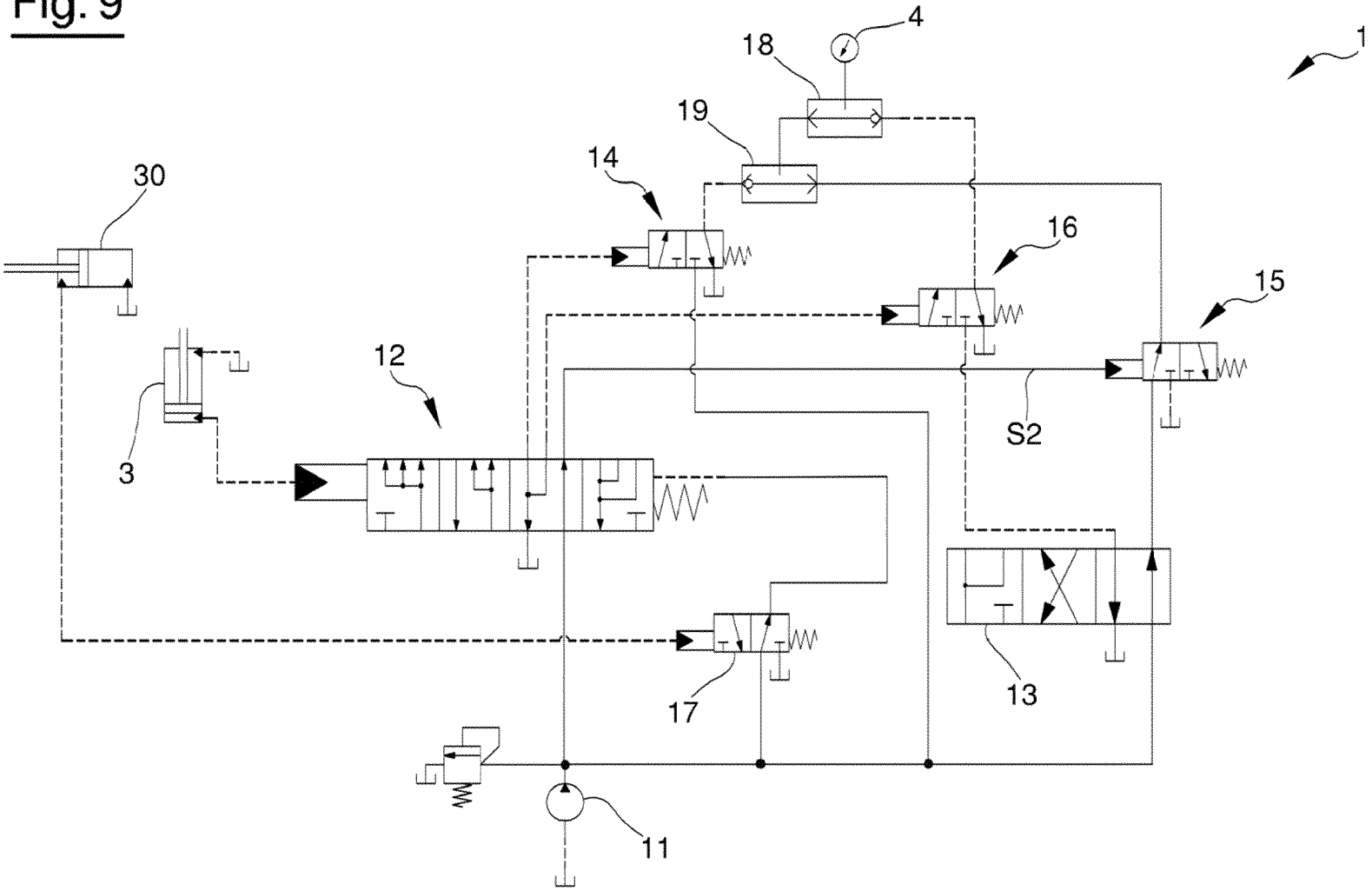

Returning to the functioning of the preferred embodiment of the invention, a description now follows of a case in which the arm 23, 24 is in a transversal position and the load is at a value that is such as to have the balance valve on the first position, which value is for example greater than 150 bar (see FIG. 9).

The transversal position of the arm 23, 24 is by way of example defined by an angle comprised between 60° and 90° with respect to the axis A of the carriage 21.

In this operating condition, as already explained above, the second load valve 15 is open; further, the distribution means 13 move into a second open configuration in which they enable the passage of the pilot fluid into the branch which comprises the second valve 15.

As a consequence, the pilot pressure is detected at the inlet of the signalling device 4 and an alarm signal is accordingly sounded.

In fact, as known, the transversal condition of the excavator arm 23, 24 is the most dangerous for the stability of the means 2 and, therefore, a load in the piston side of the first actuator 3, in the example more than 150 bar, which corresponds to the first position of the balance valve, constitutes a potential danger.

A further known factor of danger, not examined herein up to now, is constituted by a case in which, following application of a load on the excavator arm 23, 24, the arm 24 is raised from the vertical position to the horizontal position (see FIG. 3).

This action occurs by means of the activating of the second above-mentioned actuator 30.

The invention advantageously includes the detail of using the preloading valve 17 which enables taking account also of this eventuality.

Figure 10:
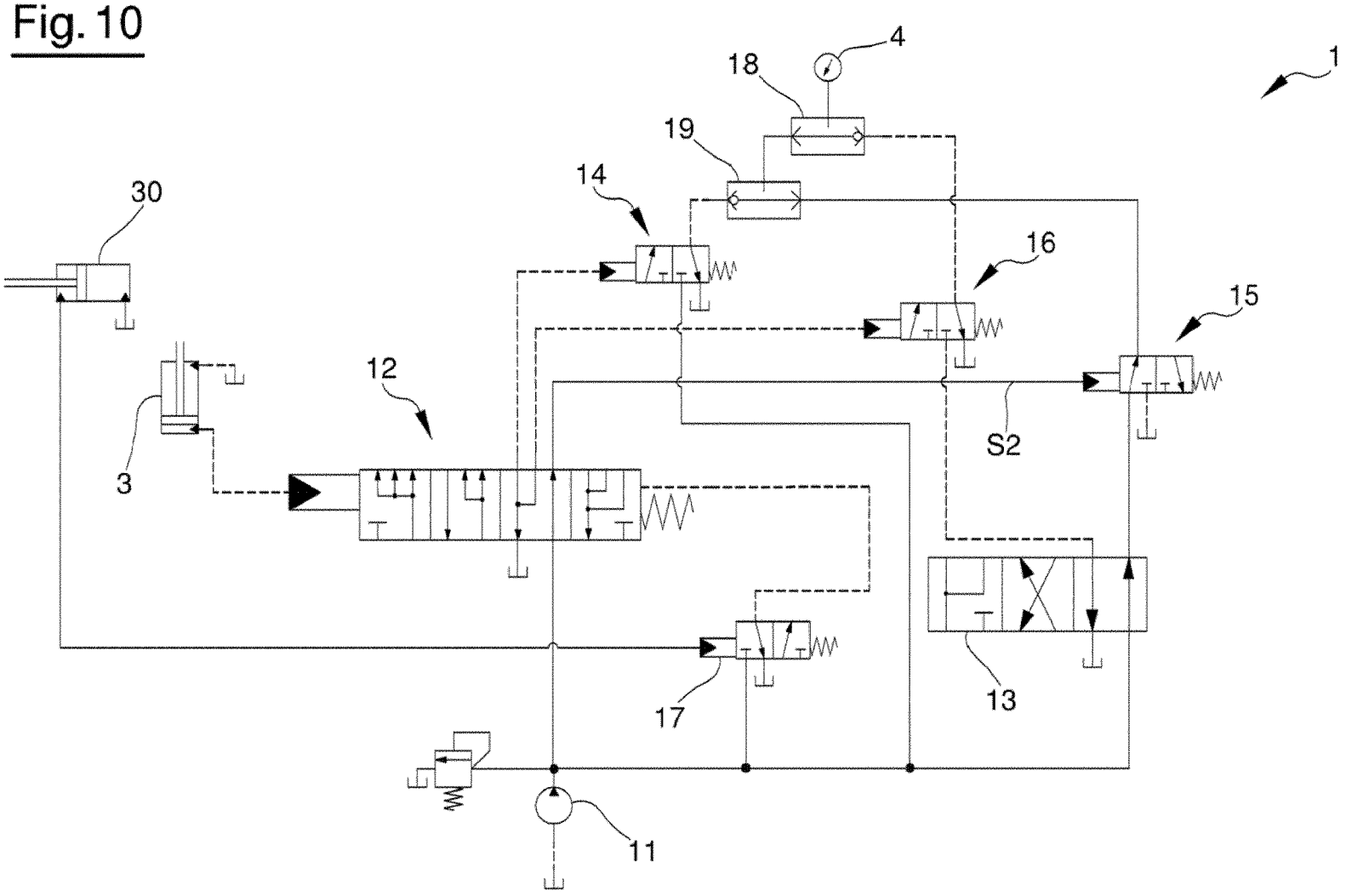

In fact, as shown in FIG. 10, when the pressure in the second actuator 30 reaches the threshold which identifies the raising of the arm 24, the preloading valve 17, normally open, switches into the closed condition, inhibiting passage of the pilot fluid from the pump to the balance valve 12.

In this situation, the balance valve 12 switches into the various open positions at pressure thresholds of the first actuator 3 which are lower than those that are valid in the preceding examples, as they are reduced by a quantity which takes into consideration the new spatial configuration of the arm.

Therefore, for example, if the arm 23, 24 is in the transversal position and the piston-side pressure of the first actuator 3 is just at 120 bar, nonetheless the balance valve 12 is in the first open position in which it controls the switching of the second alarm valve 15.

Given that the distributing means 13 are in the second opening configuration, the signalling device 4 receives the pilot pressure in inlet and therefore emits an alarm signal which warns the operator of the danger.

Thus it can be seen how the invention obviates all the drawbacks of the prior art as well as providing new and advantageous uses.

In fact, the operator can completely rely on the alarm signal of the circuit 1 of the invention; there is no need to use tables or other instruments and the operator knows he or she can use the excavating machine 2 with complete safety for lifting even considerable weights when the arm 23, 24 is in the frontal position.

Note that the circuit 1 of the invention has a functioning that is essentially of a hydraulic type and therefore does not require the use of electronics and software constituting a complication, a cost and requiring frequent updating and control.

In the preferred version of the circuit 1 of the invention, two selector valves of the fluid 18, 19, which define an OR logic for the hydraulic signals, are placed in series with one another and are interposed between the alarm valves 14, 15, 16 and the signaling device 4.

In detail, a first selector valve 18 receives in inlet the outlets of the first and second alarm valve, while the second selector valve 19 receives in inlet the outlet of the first selector valve and the outlet of the third alarm valve.

The outlet of the second OR valve is connected to the inlet of the signalling valve 4.

When one of the alarm valves 14, 15, 16 is open and receives the pilot pressure, i.e. both consent conditions are verified in the AND logic of the valve, there is the certainty that the pilot pressure in outlet therefrom will reach the signalling device 4 and there are no load losses through the outlet branches of the other alarm valves 14, 15, 16.

In fact, the OR valves define a compulsory path for the pilot fluid towards the signalling device 4, which prevents the pilot fluid from returning upstream.

The invention claimed is:

1. A hydraulic safety circuit for hydraulic machines, comprising:

a first hydraulic actuator;

a pilot pump for supplying pilot operating fluid at a pilot pressure;

a signaling device controlled by the pilot operating fluid and operable to emit an alarm signal;

a balance valve subjected to pressure of the first hydraulic actuator and able to distribute the pilot operating fluid in a plurality of hydraulic activating signals;

a hydraulic distributor to assume a plurality of operating configurations and able to distribute the pilot operating fluid according to one of the plurality of operating configurations, the hydraulic distributor being fluidly coupled to the pilot pump in parallel with the balance valve; and a plurality of alarm valves controlled by the hydraulic activating signals, at least one of the plurality of alarm valves arranged downstream of the distributor, each of the plurality of alarm valves being able to provide the pilot operating fluid to the signaling device.

2. The hydraulic safety circuit of claim 1, wherein the alarm valves are two-position hydraulically-controlled valves.

3. The hydraulic safety circuit of claim 1, wherein a first of the plurality of alarm valves is arranged directly downstream of the pilot pump, while a remaining one or more of the plurality of alarm valves are arranged downstream of the distributor.

4. The hydraulic safety circuit of claim 1, wherein the balance valve has a plurality of positions which it assumes according to the pressure of the first hydraulic actuator; in each of the positions sending different activating signals to respective ones of the plurality of alarm valves.

5. The hydraulic safety circuit claim 1, wherein the distributor provides pilot operating fluid to a different alarm valve according to one of the plurality of operating configurations.

6. The hydraulic safety circuit of claim 1, wherein the first hydraulic actuator controls movement of an articulated arm, and the pressure of the first hydraulic actuator is a function of a load acting on the arm.

7. The hydraulic safety circuit of claim 1, wherein the plurality of operating configurations of the distributor correspond to respective spatial positions assumed by the first hydraulic actuator.

8. The hydraulic safety circuit of claim 1, wherein the alarm valves are two-position hydraulically-controlled valves, and wherein the balance valve has a plurality of positions which it assumes according to the pressure of the first hydraulic actuator, in each of the positions sending different activating signals to respective ones of the plurality of alarm valves.

9. The hydraulic safety circuit claim 8, wherein the plurality of positions comprises a closed position and a plurality of open positions, wherein the balance valve is normally in the closed position and moves sequentially to each of the plurality of open positions according to the pressure of the first hydraulic actuator in such a way as to open the alarm valves in sequence.

10. The hydraulic safety circuit of claim 1, wherein the hydraulic distributor comprises a distribution valve having a hydraulic return, further comprising a second hydraulic actuator and a preloading valve subjected to the second hydraulic actuator, the preloading valve being able to enable or prevent the pilot operating fluid from acting as a preloading pressure on the distribution valve according to a pressure of the second hydraulic actuator.

11. The hydraulic safety circuit if claim 10, wherein a fluid selector valve is interposed between the alarm valves and the signaling device.

12. A hydraulic safety circuit for hydraulic machines, comprising:

a first hydraulic actuator;

a pilot pump for supplying pilot operating fluid at a pilot pressure;

a signaling device controlled by the pilot operating fluid and operable to emit an alarm signal;

a balance valve subjected to pressure of the first hydraulic actuator and able to distribute the pilot operating fluid in a plurality of hydraulic activating signals;

a hydraulic distributor to assume a plurality of operating configurations and able to distribute the pilot operating fluid according to one of the plurality of operating configurations; and a plurality of alarm valves controlled by the hydraulic activating signals, at least one of the plurality of alarm valves arranged downstream of the distributor, each of the plurality of alarm valves being able to provide the pilot operating fluid to the signaling device, wherein a first of the plurality of alarm valves is arranged directly downstream of the pilot pump, while a remaining one or more of the plurality of alarm valves are arranged downstream of the distributor.

13. The hydraulic safety circuit of claim 12, wherein the alarm valves are two-position hydraulically-controlled valves.

14. The hydraulic safety circuit of claim 12, wherein the balance valve has a plurality of positions which it assumes according to the pressure of the first hydraulic actuator, in each of the positions sending different activating signals to respective ones of the plurality of alarm valves.

15. The hydraulic safety circuit claim 14, wherein the plurality of positions comprises a closed position and a plurality of open positions, wherein the balance valve is normally in the closed position and moves sequentially to each of the plurality of open positions according to the pressure of the first hydraulic actuator in such a way as to open the alarm valves in sequence.

16. The hydraulic safety circuit claim 12, wherein the distributor provides pilot operating fluid to a different alarm valve according to one of the plurality of operating configurations.

17. The hydraulic safety circuit of claim 12, wherein the first hydraulic actuator controls movement of an articulated arm, and the pressure of the first hydraulic actuator is a function of a load acting on the arm.

18. The hydraulic safety circuit of claim 12, wherein the plurality of operating configurations of the distributor correspond to respective spatial positions assumed by the first hydraulic actuator.

19. A hydraulic safety circuit for hydraulic machines; comprising:

a first hydraulic actuator;

a second hydraulic actuator;

a pilot pump for supplying pilot operating fluid at a pilot pressure;

a signaling device controlled by the pilot operating fluid and operable to emit an alarm signal;

a balance valve subjected to pressure of the first hydraulic actuator and able to distribute the pilot operating fluid in a plurality of hydraulic activating signals;

a hydraulic distributor to assume a plurality of operating configurations and able to distribute the pilot operating fluid according to one of the plurality of operating configurations the hydraulic distributor comprising a distribution valve having a hydraulic return;

a preloading valve subjected to the second hydraulic actuator, the preloading valve being able to enable or prevent the pilot operating fluid from acting as a preloading pressure on the distribution valve according to a pressure of the second hydraulic actuator; and a plurality of alarm valves controlled by the hydraulic activating signals, at least one of the plurality of alarm valves arranged downstream of the distributor, each of the plurality of alarm valves being able to provide the pilot operating fluid to the signaling device.

20. The hydraulic safety circuit if claim 19, wherein a fluid selector valve is interposed between the alarm valves and the signaling device.

* * * * *